US006299352B1

(12) United States Patent
Julien

(10) Patent No.: US 6,299,352 B1
(45) Date of Patent: Oct. 9, 2001

(54) BAG WITH INTEGRALLY FORMED PERIMETRICALLY EXTENDING POCKET

(76) Inventor: Lawrence Julien, 9 Ferncliff Rd., Scarsdale, NY (US) 10583

( * ) Notice: Subject to any disclaimer, the term of this patent is extended or adjusted under 35 U.S.C. 154(b) by 0 days.

(21) Appl. No.: 09/565,599

(22) Filed: May 4, 2000

(51) Int. Cl.[7] ..... B65D 30/22

(52) U.S. Cl. ..... 383/40; 383/20; 383/119; D9/305

(58) Field of Search ..... 383/2, 87, 120, 383/75, 105, 27, 38, 39, 40, 119, 20; 229/87.03, 922; D9/305

(56) References Cited

U.S. PATENT DOCUMENTS

| | | | | |
|---|---|---|---|---|
| D. 263,899 | | 4/1982 | Lynn . | |
| D. 334,839 | | 4/1993 | Dancyger . | |
| D. 417,079 | * | 11/1999 | Heltzel | D3/315 |
| 1,858,159 | | 5/1932 | Laymon . | |
| 2,177,972 | | 10/1939 | Altheimer . | |
| 3,746,066 | * | 7/1973 | McIntyre | 383/75 X |
| 4,156,446 | | 5/1979 | Nathan . | |
| 4,784,314 | * | 11/1988 | Penick | 229/922 X |
| 4,993,551 | * | 2/1991 | Lindsay | 383/39 X |
| 5,326,575 | | 7/1994 | Spaulding . | |
| 5,836,095 | | 11/1998 | Crowell . | |

* cited by examiner

*Primary Examiner*—Jes F. Pascua
(74) *Attorney, Agent, or Firm*—R. Neil Sudol; Henry D. Coleman; William J. Sapone

(57) ABSTRACT

A bag comprises a bottom panel and a sidewall connected to the bottom panel about a periphery thereof, the sidewall defining a mouth located on a side of the sidewall opposite the bottom panel. The sidewall is folded back on itself at least twice to form a sidewall region with at least three coextensive and adjacent sections of the sidewall. The sidewall has a pair of folds defining a circumferentially or perimetrically extending first edge on an outer side of the sidewall and a circumferentially or perimetrically extending second edge on an inner side of the sidewall. The folds define a pair of circumferentially extending pockets, one on the outer side of the bag sidewall and another on the inner side of the sidewall. A reinforcement board is inserted in one of the pockets. Decorative graphics overlay the pockets.

18 Claims, 2 Drawing Sheets

BAG WITH INTEGRALLY FORMED PERIMETRICALLY EXTENDING POCKET

BACKGROUND OF THE INVENTION

This invention relates to a bag. The bag is particularly useful as a shopping bag.

Shopping bags are a ubiquitous feature of bricks and mortar shopping. Where retail products are of a luxury quality, retailers and customers are interested in transporting the goods in shopping bags which are distinctive and attractive. In addition, it is advantageous in many cases for such shopping bags to be strong and durable. Where the bags are sufficiently attractive and sturdy, customers will wish to reuse them even on occasions other than shopping expeditions.

OBJECTS OF THE INVENTION

An object of the present invention is to provide a shopping bag.

A more particular object of the present invention is to provide a reinforced shopping bag.

A further object of the present invention is to provide such as bag which is simple in construction, durable and sturdy in use.

It is an additional object of the present invention to provide such a bag which is attractive in appearance and which lends itself to decoration.

These and other objects of the present invention will be apparent from the drawings and descriptions herein.

SUMMARY OF THE INVENTION

A bag comprises in accordance with the present invention, a bottom panel and a sidewall connected to the bottom panel about a periphery thereof. The sidewall is folded back on itself and defines a mouth located on a side of the sidewall opposite the bottom panel.

More specifically, the sidewall has at least a first fold and a second fold spaced therefrom to define a circumferentially or perimetrically extending first edge on an outer side of the sidewall and a circumferentially or perimetrically extending second edge on an inner side of the sidewall. The fold edges are disposed in respective planes oriented substantially perpendicularly to a longitudinal or vertical axis of the bag. Thus, in a continuous region including the two folds, the sidewall has a zig-zag or Z-shaped cross-section taken in a longitudinal plane oriented parallel to the axis. The sidewall is folded back on itself at least twice to form a section with at least three coextensive sections of the sidewall.

The two folds further define a circumferentially extending first pocket on the outer side of the bag sidewall and a circumferentially extending second pocket on the inner side of the sidewall. In one embodiment of the invention. The second or inner pocket is accessible from the bottom end of the bag, while the first or outer pocket is accessible from the upper end (the mouth end) of the bag.

Where the second edge is a lower edge, located more proximately than the first edge to the bottom panel of the bag, the outer pocket is partially utilitarian, as the outer pocket provides a compartment for the transport of appropriate items. Whether the outer pocket is open in an upward or a downward direction, the outer pocket is distinctive, thus performing an aesthetic or decorative function. In addition, the folded-over section of the bag serves as a brace which strengthens the bag and maintains it in an opened configuration during use.

Further support is provided, in accordance with another feature of the present invention, by disposing at least one reinforcement board in the second pocket. This board provides the first pocket with a substantially stiff outer wall.

In accordance with a further feature of the present invention, a decorative graphic design is disposed in part on an outer side of the stiff outer wall of the outer pocket. The graphic design preferably includes a portion projecting from a side of the outer edge or fold opposite the inner edge or fold. In the one embodiment of the invention where the outer pocket opens in an upward direction, the projecting portion of the graphic design projects toward the upper end of the bag from the lip or rim of the outer pocket.

This graphic decoration and the projecting thereof beyond the rim or lip of the outer pocket provides an enhanced distinctive look to the bag, and substantially increases the possible variations in appearance.

The graphic design may take virtually any form. It may be representational or abstract. Representational designs exemplarily include illustrations of animals or plants, human figures or visages, and landscape scenes. Abstract designs exemplarily include trademarks and logos, as well as geometric designs. The graphic design may also take a three-dimensional form, such as a relief.

Preferably, a reinforcement element is at least partially coextensive with and connected to the projecting portion of the graphic design for support purposes. The reinforcement element may include a cutout portion of the sidewall contiguous with the first edge. The reinforcement element may further include a board section bonded to the cutout portion of the sidewall. This board section may be continuous or contiguous with the reinforcement board disposed in the second pocket of the bag.

It is generally contemplated that the bag sidewall includes four sidewall panels, i.e., the bag has a rectangular cross-section in a plane taken perpendicular to the vertical axis of the bag. In this case, the reinforcement board is preferably one of at least two reinforcement boards disposed in the second pocket along opposite sidewall panels of the sidewall.

A shopping bag in accordance with the present invention is simple in construction, and yet durable and sturdy in use. Moreover, the bag is attractive and distinctive and replete with countless decorative possibilities.

DESCRIPTION OF THE PREFERRED EMBODIMENTS

Figure 1:
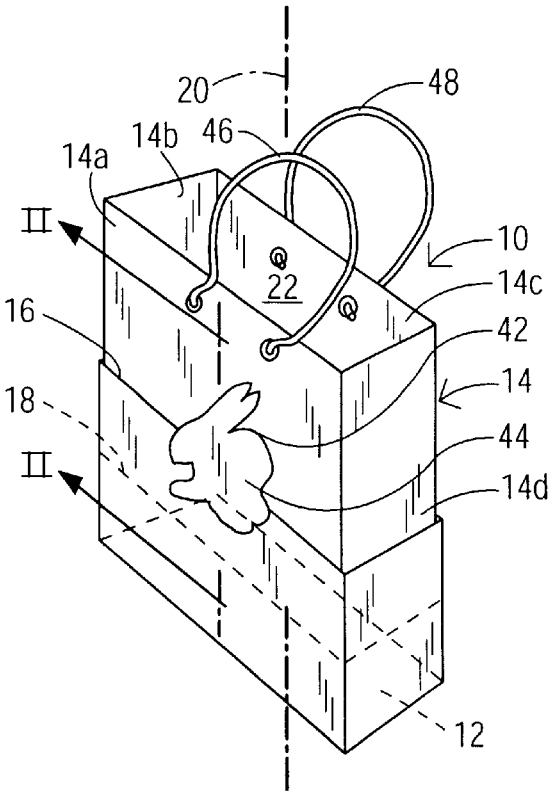
FIG. 1 is a schematic perspective view of a shopping bag in accordance with the present invention.
Figure 2:
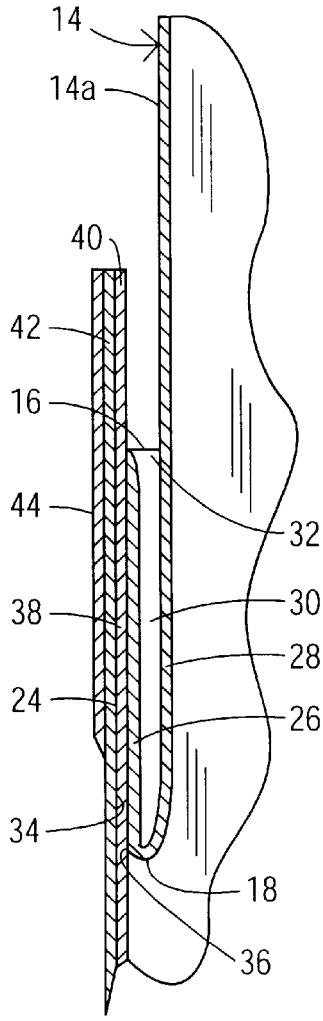
FIG. 2 is a schematic partial cross-sectional view taken along plane II—II in FIG. 1.

FIGS. 1 and 2 show a bag 10 having a bottom panel 12 and a sidewall 14 connected to the bottom panel along a periphery (not separately designated) thereof. Sidewall 14 is folded back on itself twice to form two circumferentially or perimetrically extending rectangular edges 16 and 18 located in respective planes (not illustrated) oriented perpendicular to a vertical axis 20 of the bag 10. Edge 16 is disposed outside of bag 10, while edge 18 is disposed inside the bag. Inside edge 18 is located closer than outside edge 16 to bottom panel 12, whereas outside edge 16 is closer than inside edge 18 to a mouth opening 22 of bag 10.

In a region including folds or edges 16 and 18, sidewall 14 has a zig-zag or Z-shaped cross-section with three overlapping or coextensive sections or areas 24, 26, and 28. Sidewall sections 24 and 26 define a circumferentially extending outer pocket 30 accessible from outside the bag 10, particularly from the upper end of the bag. Outer pocket 30 has an opening 32 defined or bounded by edge 16 and facing upwardly, in the direction mouth 22. Sidewall sections 26 and 28 flank a circumferentially extending inner pocket 34 which is accessible only through the inside of the bag 10. Inner pocket 34 has an opening 36 which faces downwardly, towards bottom panel 12.

A cardboard reinforcement panel 38 is inserted into inner pocket 34. Panel or insert 38 is generally rectangular and is provided along an upper edge with a die cut support board 40 forming the upper portion of a decorative silhouette, in this case a silhouette of a rabbit. The material of bag 10, and particularly of sidewall section 26, is also die cut in geometrically similar fashion to form a rabbit ear shaped section 42 extending over the silhouette defined by support board 40. A decorative graphics patch 44 in the form of a rabbit is adhered to bag sidewall section 24 and overlies the bag material and the support board 40, as well as in an area below the profile. Thus, a portion of decorative graphics patch 44, as well as support board 40, projects from outer edge or rim 16 of outer pocket 30 towards mouth 22 and away from inner edge 18 parallel to axis 20. Support board 40 may be continuous and integral with reinforcement panel or insert 38 or may be a separate cardboard section disposed adjacent to reinforcement panel or insert 38 and connected thereto by the die cut portion of sidewall section 26.

Bag sidewall 14 includes four sidewall panels 14*a*, 14*b*, 14*c*, 14*d* so that bag 10 has a rectangular cross-section in a plane taken perpendicular to axis 20. Reinforcement panel or insert 28 is preferably one of at least two reinforcement boards disposed in inner pocket 34 along opposite sidewall panels 14*a* and 14*c* of sidewall 14. The reinforcement panels or inserts 38 (only one shown) provide outer pocket 30 with a substantially stiff outer walls on opposite sides of bag sidewall 14.

Bag 10 is provided with a pair of cords 46 and 48 which are knotted to the bag sidewall panels 14*a* and 14*c*, respectively, and which serve as handles or grips.

Figure 3:
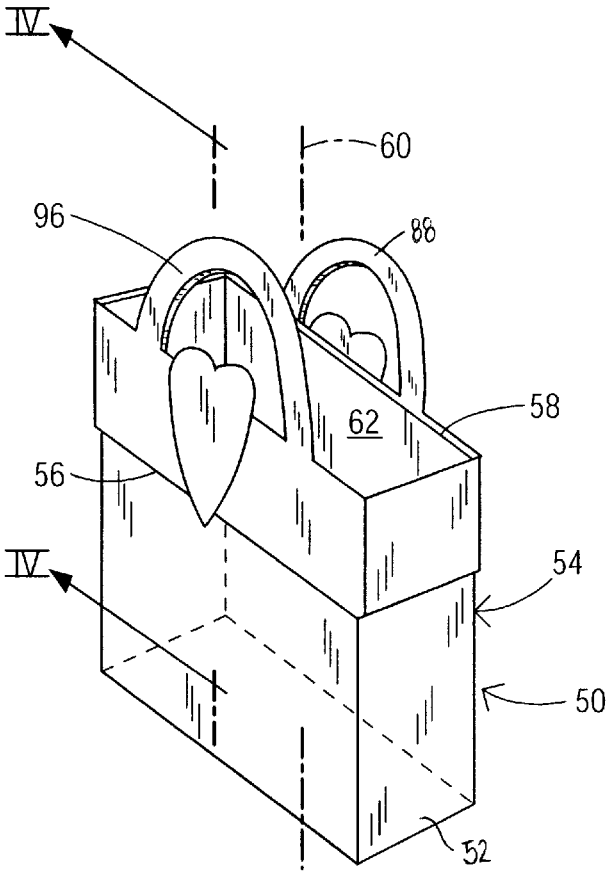
FIG. 3 is a schematic perspective view of another shopping bag in accordance with the present invention.
Figure 4:
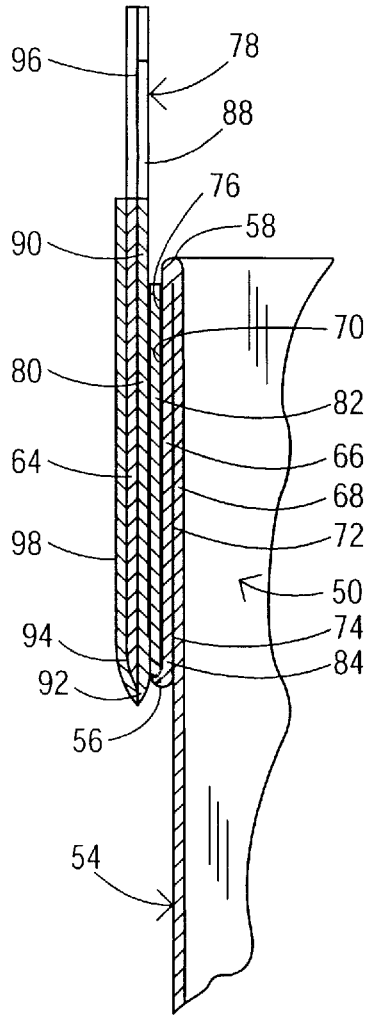
FIG. 4 is a schematic partial cross-sectional view taken along plane IV—IV in FIG. 3.
Figure 5:
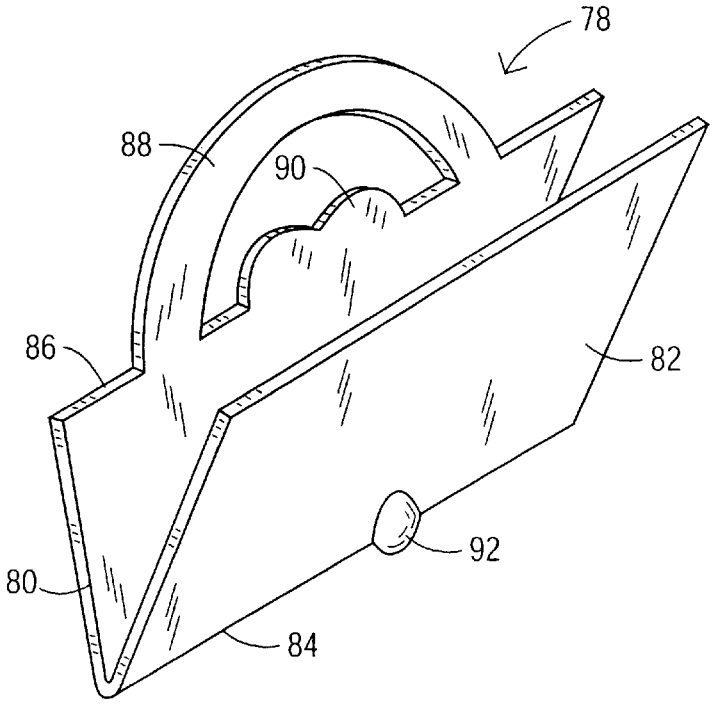
FIG. 5 is a schematic perspective view, on a larger scale, of a cardboard insert used in the bag of FIG. 3.

FIGS. 3–5 show another bag 50 having a bottom panel 52 and a sidewall 54 connected to the bottom panel along a periphery (not separately designated) thereof. Sidewall 54 is folded back on itself twice to form two circumferentially or perimetrically extending rectangular edges 56 and 58 located in respective planes (not illustrated) oriented perpendicularly to a vertical axis 60 of the bag 50. Edge 56 is disposed outside of bag 50, while edge 58 is disposed inside the bag. Outer edge 56 is located closer than inner edge 58 to bottom panel 52, whereas inner edge 58 is proximate to a mouth opening 62 of bag 50.

In a region including folds or edges 56 and 58, sidewall 54 has a zig-zag or Z-shaped cross-section with three overlapping or coextensive sections or areas 64, 66, and 68. Sidewall sections 64 and 66 define a first circumferentially extending pocket 70, and sidewall sections 66 and 68 define a second circumferentially extending pocket 72. Pocket 70 is located radially outside pocket 72, relative to the axis 60 of bag 50. However, for purposes of this disclosure, pocket 70 is the inner pocket since it opens toward, or is accessible from, the inside of bag 50. Concomitantly, for purposes of this disclosure, pocket 72 is the outer pocket since it opens towards, or is accessible from, the outside of the bag. Outer pocket 72 has an opening 74 defined or bounded by edge 56 and facing downwardly, towards bottom panel 52. Inner pocket 70 has an opening 76 which faces upwardly an is accessible though mouth opening 62 of bag 50.

A pair of cardboard reinforcement panels 78 (only one shown) are inserted into inner pocket 70 along opposite panels (not designated) of sidewall 54. Each insert 78 includes two generally rectangular boards 80 and 82 connected to one another along a fold line 84. Board 80 is formed along an upper edge 86 with an integral loop 88 which serves as a handle grip for bag 50. Board 80 is also formed along upper edge 86 with an upwardly projecting die-cut profile or extension 90, in this case in the form of two intersecting semicircles (not separately designated). Along fold line 84, board 80 has a downwardly projecting extension 92 which is formed by cutting through the respective insert 78 prior to the folding of the insert along fold line 84. The material of bag 50, and particularly of sidewall section 66, is also cut and folded out to form an extended portion 94 geometrically similar to extension 92 and bonded thereto. Moreover, sidewall 54 is formed with a pair of opposing U-shaped extensions 96 each substantially coextensive with and connected to a respective loop 88. A decorative graphics overlay 98, in this case in the shape of a heart, is disposed over sidewall section 64 and particularly over profiles or extensions 90 and 92. In the regions of extensions 90 and 92, bag 50 has three layers of material, namely, an extension 90 or 92, the paper of the bag, and overlay 98.

Although the invention has been described in terms of particular embodiments and applications, one of ordinary skill in the art, in light of this teaching, can generate additional embodiments and modifications without departing from the spirit of or exceeding the scope of the claimed invention. For example, reinforcement panels 78 need not include secondary boards 82. A single layer formed by board 80 is sufficient to reinforce bag 50 in the region of pockets 70 and 72. Accordingly, it is to be understood that the drawings and descriptions herein are proffered by way of example to facilitate comprehension of the invention and should not be construed to limit the scope thereof.

What is claimed is:

1. A bag comprising:

a bottom panel;

a sidewall connected to said bottom panel about a periphery thereof, said sidewall defining a mouth located on a side of said sidewall opposite said bottom panel, said sidewall being folded back on itself, said sidewall having a first fold defining a circumferentially or perimetrically extending first edge on an outer side of said sidewall, said sidewall having a second fold defining a circumferentially or perimetrically extending second edge on an inner side of said sidewall, said first fold and said second fold defining a circumferentially extending first pocket on said outer side of said sidewall and a circumferentially extending second pocket on said inner side of said sidewall; and at least one reinforcement board disposed in said second pocket, to provide said first pocket with a substantially stiff outer wall.

2. The bag defined in claim 1, further comprising a decorative graphic design disposed in part on an outer side of said stiff outer wall, said graphic design including a portion projecting from a side of said first edge opposite said second edge.

3. The bag defined in claim 2, further comprising a reinforcement element at least partially coextensive with and connected to said portion of said graphic design for supporting said portion of graphic design.

4. The bag defined in claim 3 wherein said reinforcement element includes a cutout portion of said sidewall contiguous with said first edge.

5. The bag defined in claim 4 wherein said reinforcement element further includes a board section bonded to said cutout portion of said sidewall.

6. The bag defined in claim 1 wherein said sidewall includes four sidewall panels, said reinforcement board being one of at least two reinforcement boards disposed in said second pocket along opposite sidewall panels of said sidewall.

7. The bag defined in claim 1 wherein said second edge is located more proximately than said first edge to said bottom panel, said sidewall having a first end at said mouth and a second end at said bottom panel, said first pocket being accessible from said first end, said second pocket being accessible from said second end.

8. The bag defined in claim 1 wherein, in a continuous region including said first fold and said second fold, said sidewall has a zig-zag or Z-shaped cross-section taken in a longitudinal plane oriented parallel to said axis.

9. The bag defined in claim 1 wherein said sidewall has an axis, said bottom panel being oriented substantially perpendicularly to said axis, said first opening and said second opening extending in respective planes oriented substantially perpendicularly to said axis.

10. A bag comprising:

a bottom panel;

a sidewall connected to said bottom panel about a periphery thereof, said sidewall defining a mouth located on a side of said sidewall opposite said bottom panel, said sidewall being folded back on itself, said sidewall having a first fold defining a circumferentially or perimetrically extending first edge on an outer side of said sidewall, said sidewall having a second fold defining a circumferentially or perimetrically extending second edge on an inner side of said sidewall, said first fold and said second fold defining a circumferentially extending first pocket on said outer side of said sidewall and a circumferentially extending second pocket on said inner side of said sidewall; and a decorative graphic design disposed in part on said sidewall on an outer side of said first pocket, said graphic design including a portion projecting from a side of said first edge opposite said second edge.

11. The bag defined in claim 10, further comprising a reinforcement element at least partially coextensive with and connected to said portion of said graphic design for supporting said portion of graphic design.

12. The bag defined in claim 11 wherein said reinforcement element includes a cutout portion of said sidewall contiguous with said first edge.

13. The bag defined in claim 12 wherein said reinforcement element further includes a board section bonded to said cutout portion of said sidewall.

14. A bag comprising:

a bottom panel;

a sidewall connected to said bottom panel about a periphery thereof, said sidewall defining a mouth located on a side of said sidewall opposite said bottom panel, said sidewall being folded back on itself at least twice to form a sidewall region with at least three coextensive and adjacent sections of said sidewall, said sidewall having a first fold defining a circumferentially or perimetrically extending first edge on an outer side of said sidewall, said sidewall having a second fold defining a circumferentially or perimetrically extending second edge on an inner side of said sidewall, said second edge being located more proximately than said first edge to said bottom panel, said first fold and said second fold defining a circumferentially extending first pocket on said outer side of said sidewall and a circumferentially extending second pocket on said inner side of said sidewall, said sidewall having a first end at said mouth and a second end at said bottom panel, said first pocket being accessible from said first end, said second pocket being accessible from said second end; and at least one reinforcement board disposed in said second pocket, to provide said first pocket with a substantially stiff outer wall.

15. The bag defined in claim 14, further comprising a decorative graphic design disposed in part on an outer side of said stiff outer wall, said graphic design including a portion disposed on a side of said first edge opposite said bottom panel and said second end, said portion of said graphic design projecting toward said first end from said first edge.

16. The bag defined in claim 15, further comprising a reinforcement element at least partially coextensive with and connected to said portion of said graphic design for supporting said portion of graphic design.

17. The bag defined in claim 16 wherein said reinforcement element includes a cutout portion of said sidewall contiguous with said first edge.

18. The bag defined in claim 17 wherein said reinforcement element further includes a board section bonded to said cutout portion of said sidewall.

* * * * *